US007663042B1

(12) United States Patent
Chen

(10) Patent No.: US 7,663,042 B1
(45) Date of Patent: Feb. 16, 2010

(54) ADJUSTABLE PEDAL ASSEMBLY FOR A PERCUSSION INSTRUMENT

(76) Inventor: Kuo-Chang Chen, No. 218, Ln. 39, Sec. 1, Yongxing Rd., Wuqui Chen, Taichung Hsien (TW)

( * ) Notice: Subject to any disclaimer, the term of this patent is extended or adjusted under 35 U.S.C. 154(b) by 0 days.

(21) Appl. No.: 12/419,895

(22) Filed: Apr. 7, 2009

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 5,936,177 A * 8/1999 Shigenaga ..... 84/422.1

* cited by examiner

*Primary Examiner*—Kimberly R Lockett
(74) *Attorney, Agent, or Firm*—patenttm.us

(57) ABSTRACT

An adjustable pedal assembly has a base, a beater assembly, and a pedal. The base has a pedal end and a beater end. The beater assembly is mounted on the beater end of the base. The pedal is mounted pivotally on the base and connected to the beater assembly, and has a stationary heel, an adjustment bracket, a moving sole and a rigid link. The stationary heel is mounted securely on the pedal end of the base. The adjustment bracket is mounted pivotally on the stationary heel. The moving sole is connected pivotally on the adjustment bracket and connected to the beater assembly. The rigid link is selectively connected the stationary heel and alternately to the adjustment bracket and the moving sole to change a pivoting point and swinging length of the pedal.

10 Claims, 7 Drawing Sheets

ADJUSTABLE PEDAL ASSEMBLY FOR A PERCUSSION INSTRUMENT

BACKGROUND OF THE INVENTION

1. Field of the Invention

The present invention relates to a pedal assembly, and more particularly to an adjustable pedal assembly for a percussion instrument with changeable pedal length to adjust a stamping force.

2. Description of Related Art

With reference to FIG. 7, a conventional pedal assembly has a base (60), a beater assembly (70) and a pedal. The base (60) is a board and has a beater end and a pedal end.

The beater assembly (70) is mounted on the beater end of the base (60), and has two corresponding stands, a rotating shaft, a stick mount, a chain and a beater stick. The stands are mounted on the beater end of the base (60). The rotating shaft is rotatably mounted between the stands. The stick mount is mounted on the rotating shaft. The chain has a stick mount end and a pedal end. The stick mount end of the chain is connected to the stick mount. The pedal end of the chain extends from the stick mount. The beater stick is connected to and protrudes from the stick mount and has a beater head.

The pedal is connected to the base (60) and the beater assembly, and has a stationary heel (61) and a moving sole (62). The stationary heel (61) is mounted securely on the pedal end of the base (60). The moving sole (62) has a pivoting end and a beater end. The pivoting end of the moving sole (62) is connected pivotally to the stationary heel (61). The beater end of the moving sole (62) is connected to the pedal end of the chain, and is activated to pull the chain and drive the beater stick.

In use, the moving sole (62) is trodden down to pull the chain connected to the stick mount to rotate the stick mount and drive the beater stick to beat a percussion instrument, such as a drum, high hat or the like.

However, the conventional pedal assembly has a fixed pivot at a position where the moving sole (62) is connected to the stationary heel (61). The force length is a fixed length of the moving sole (62) and is unchangeable. Therefore, the conventional pedal assembly cannot be adjusted to fit different uses for different music genres or musical styles so is not versatile.

To overcome the shortcomings, the present invention tends to provide an adjustable pedal assembly to mitigate or obviate the aforementioned problems.

SUMMARY OF THE INVENTION

The main objective of the invention is to provide an adjustable pedal assembly for a percussion instrument and having changeable pedal length to adjust a stamping force.

The adjustable pedal assembly has a base, a beater assembly, and a pedal. The base has a pedal end and a beater end. The beater assembly is mounted on the beater end of the base. The pedal is mounted pivotally on the base and connected to the beater assembly, and has a stationary heel, an adjustment bracket, a moving sole and a rigid link. The stationary heel is mounted securely on the pedal end of the base. The adjustment bracket is mounted pivotally on the stationary heel. The moving sole is connected pivotally on the adjustment bracket and connected to the beater assembly. The rigid link is selectively connected the stationary heel and alternately to the adjustment bracket and the moving sole to change a pivoting point and a swinging length of the pedal.

Other objects, advantages and novel features of the invention will become more apparent from the following detailed description when taken in conjunction with the accompanying drawings.

DETAILED DESCRIPTION OF PREFERRED EMBODIMENT

Figure 1:
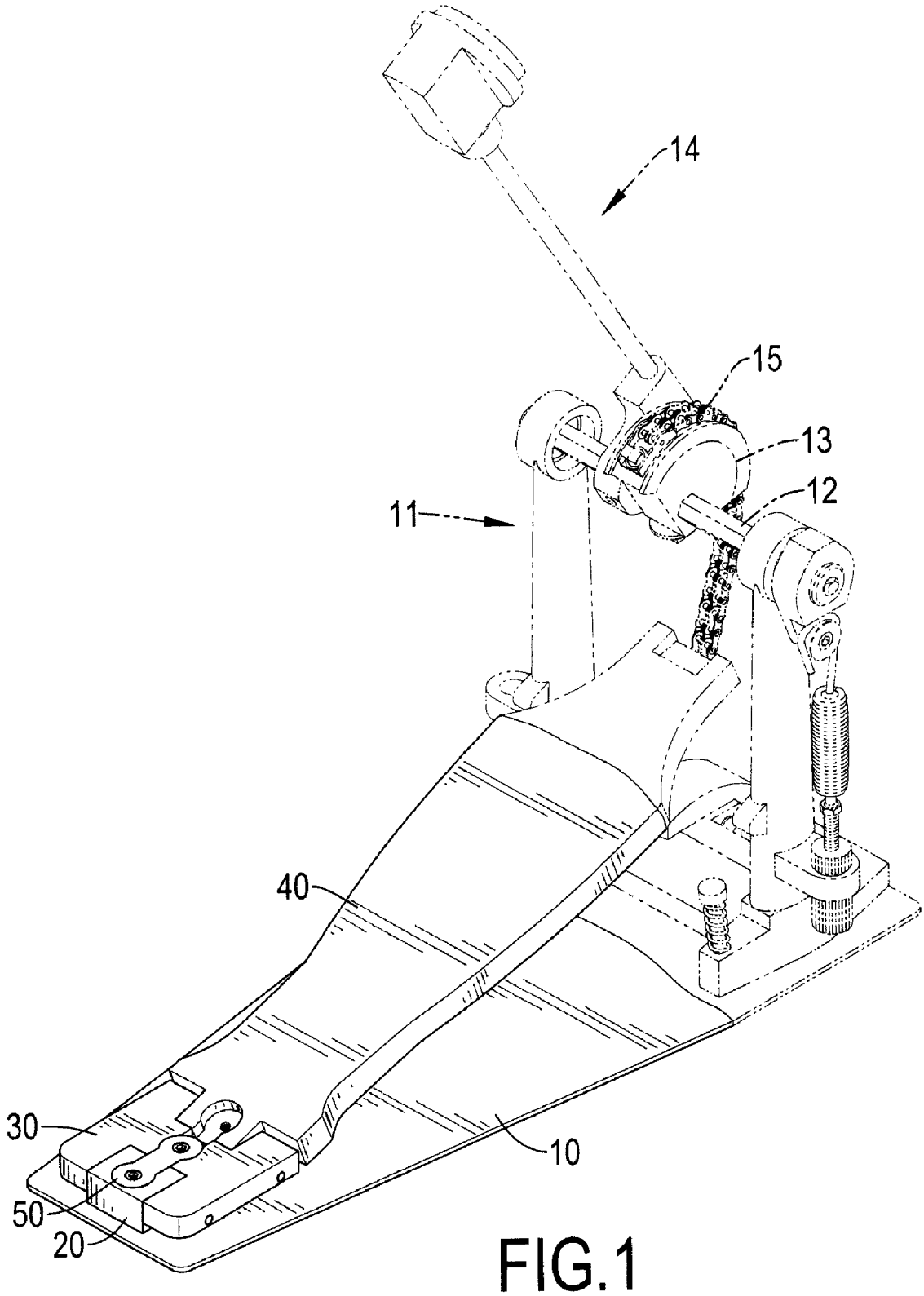
FIG. 1 is a perspective view of an adjustable pedal assembly in accordance with the present invention.

With reference to FIG. 1, an adjustable pedal assembly in accordance with the present invention is applied to a percussion instrument, such as a drum or a high hats and has a base (10), a beater assembly and a pedal. The base (10) is a board and has a pedal end and a beater end. The beater end is disposed adjacent to the percussion instrument.

The beater assembly is mounted on the beater end of the base (10) and may have two corresponding stands (11), a rotating shaft (12), a stick mount (13), a chain (15) and a beater stick (14). The stands (11) are mounted on the beater end of the base (10). The rotating shaft (12) is rotatably mounted between the stands (11).

The stick mount (13) is mounted on the rotating shaft (12), may be a quarter disc and has an arc surface and a chain recess. The chain recess is formed in the arc surface of the stick mount (13) and may have multiple teeth. The chain (15) has a stick mount end and a pedal end. The stick mount end of the chain (15) is mounted in the chain recess and is connected to the stick mount (13) and may engage the teeth. The pedal end extends from the arc surface of the stick mount (13). The beater stick (14) is mounted on and protrudes from the stick mount (13) and has a beater head.

The pedal is mounted pivotally on the base (10) and connected to the beater assembly, can be trodden on to pivot down and drive the beater stick (14) to sound a percussion instrument, and has a stationary heel (20), an adjustment bracket (30), a moving sole (40) and a rigid link (50).

Figure 2:
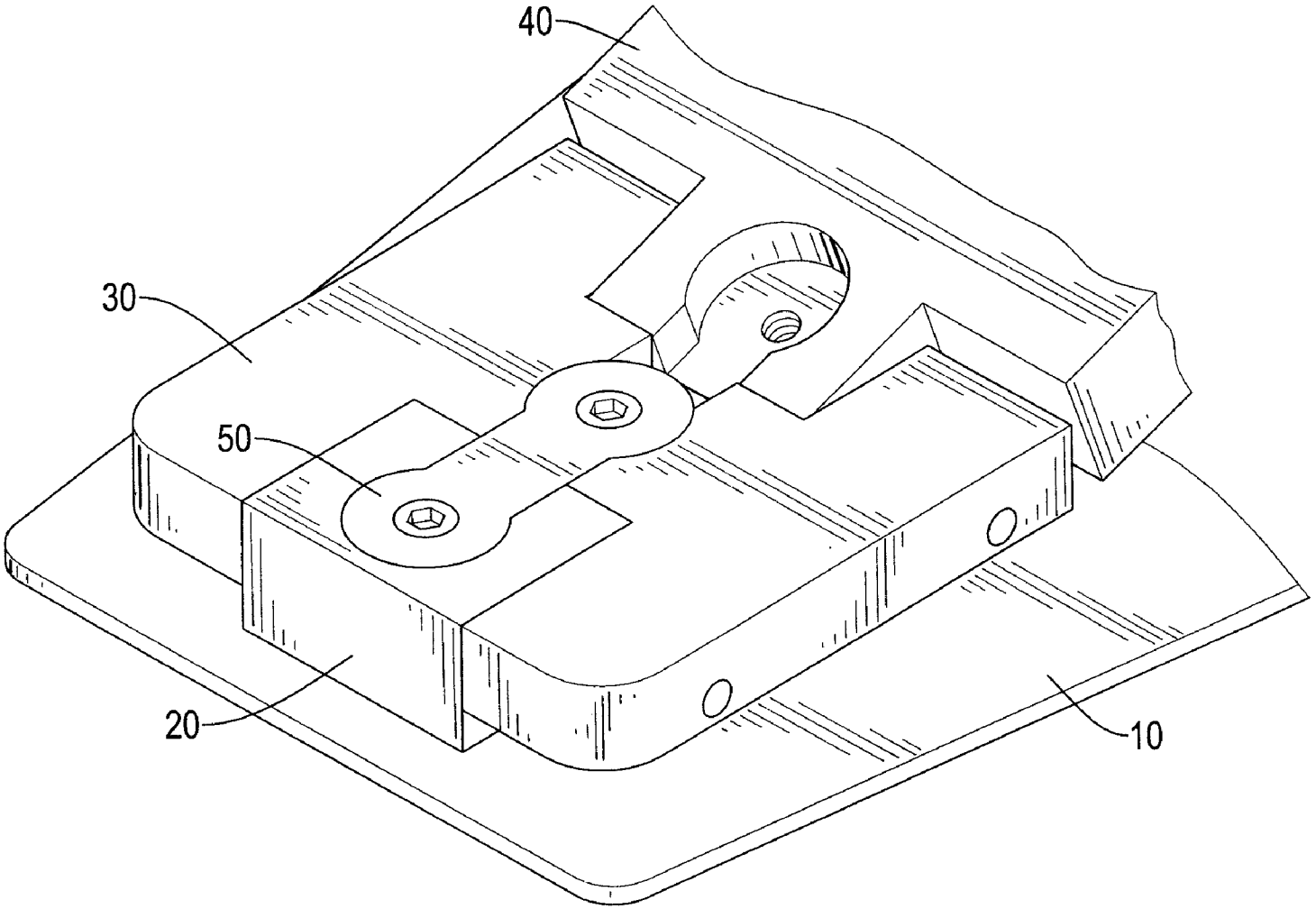
FIG. 2 is an enlarged perspective view of the adjustable pedal assembly in FIG. 1.
Figure 3:
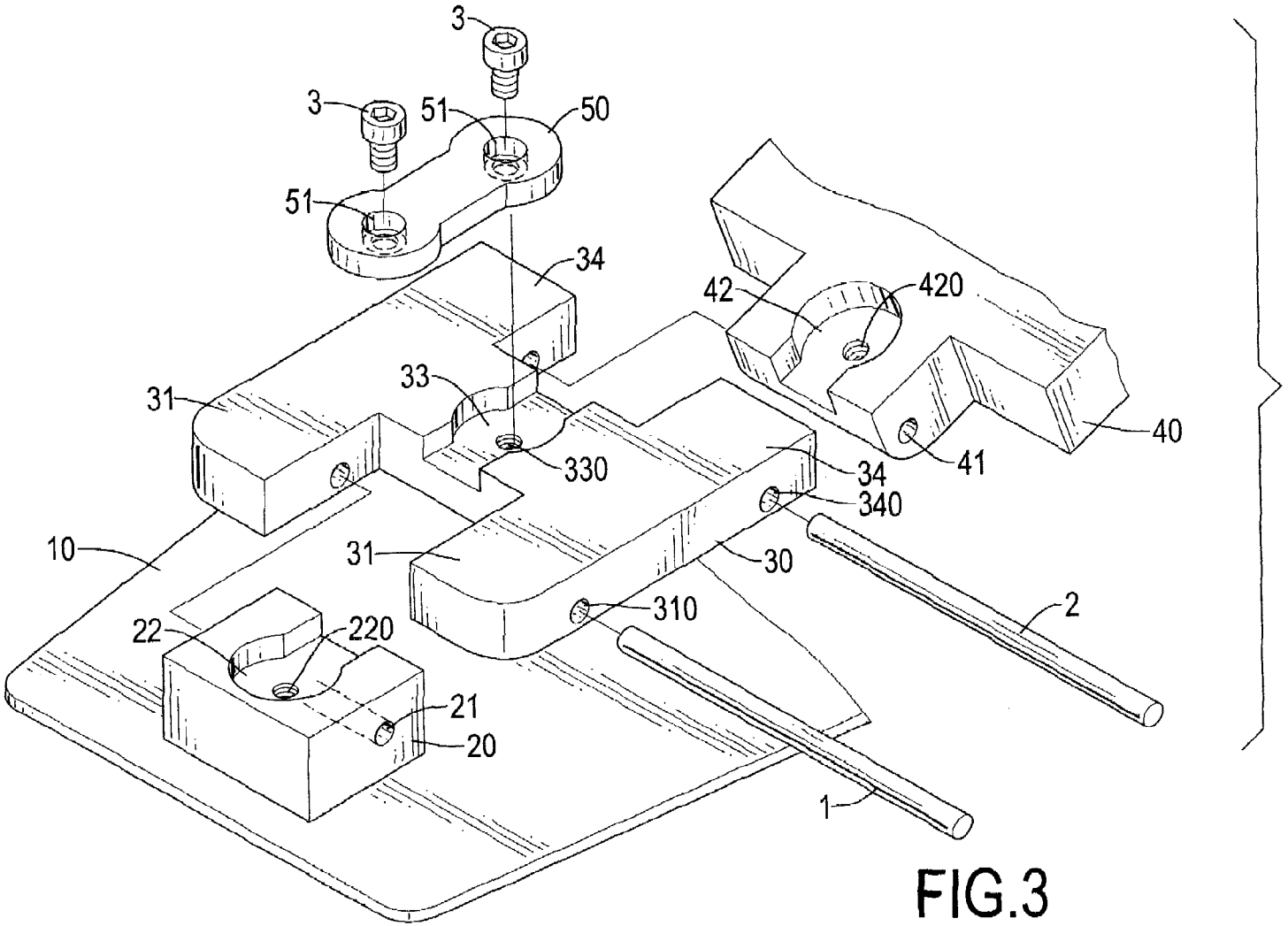
FIG. 3 is an enlarged, exploded perspective view of the pedal of the adjustable pedal assembly in FIG. 2.

With further reference to FIGS. 2 and 3, the stationary heel (20) is mounted securely on the pedal end of the base (10), and has a stationary surface, an inner surface, a stationary pivoting hole (21), a stationary recess (22) and a fixing hole (220). The stationary surface of the stationary heel (20) is parallel with the base (10). The stationary pivoting hole (21) is transversally formed through the stationary heel (20). The stationary recess (22) is formed in the stationary surface and extends through the inner surface of the stationary heel (20) and has a bottom. The fixing hole (220) is formed in the bottom of the stationary recess (22) and may be a threaded hole.

The adjustment bracket (30) is pivotally connected to the stationary heel (20), and has a stationary pivoting end (31), a central segment and a sole pivoting end (34).

The stationary pivoting end (31) is connected pivotally to the stationary heel (20), may be at least one pivoting arm protruding from the central segment, and has a stationary through hole (310) and a stationary shaft (1). The stationary through hole (310) is formed through the stationary pivoting end (31) and aligns with the stationary pivoting hole (21). The stationary shaft (1) is mounted through the stationary through hole (310) and stationary pivoting hole (21) to pivotally connect the adjustment bracket (30) with the stationary heel (20).

The central segment is formed on and protrudes from the stationary pivoting end and has a stationary side, a sole side, a link recess (33) and a connecting hole (330). The stationary side is opposite to the sole side faces the stationary heel (20). The link recess (33) is formed in the adjustment bracket (30) from the stationary side to the sole side of the central segment, corresponds to the stationary recess (22) and has a bottom. The connecting hole (330) is formed in the bottom of the link recess (33) and may be a threaded hole.

The sole pivoting end (34) is formed on and protrudes from the central segment, may have at least one pivoting arm protruding from the sole side of the central segment, and has a sole through hole (340). The sole through hole (340) is transversally formed through the sole pivoting end (34).

The moving sole (40) may be an elongated board, is connected pivotally to the adjustment bracket (30) and connected to the beater assembly, and has a pivoting end and a beater end. The pivoting end of the moving sole (40) is connected pivotally to the sole pivoting end (34) of the adjustment bracket (30), may be formed adjacent to at least one pivoting arm of the sole pivoting end (34) of the adjustment bracket (30), and has a sole pivoting hole (41), a sole shaft (2), a sole surface, an inner surface, a sole recess (42) and a fixing hole (420). The sole pivoting hole (41) is formed through the pivoting end of moving sole (40), and aligns with the sole through hole (340). The sole shaft (2) is mounted through the sole pivoting hole (41) and the sole through hole (340) to pivotally connect the moving sole (40) with the adjustment bracket (30). The sole surface of the pivoting end of the moving sole (40) faces opposite the base (10). The inner surface of the pivoting end of the moving sole (40) faces the pedal end of the base (10). The sole recess (42) is formed in the slot surface of the pivoting end of the moving sole (40), extends through the inner surface, aligns with the link recess (33) and has a bottom. The fixing hole (420) is formed in the bottom of the sole recess (42) and may be a threaded hole. The beater end of the moving sole (40) is connected securely to the pedal end of the chain (15) of the beater assembly.

The rigid link (50) is selectively connected between the adjustment bracket (30) and alternately to the stationary heel (20) and the moving sole (40) to adjust the length of the pedal. The rigid link (50) may be a flat shaft and has two mounting ends, two fastening holes (51) and two fasteners (3). One of the mounting ends of the rigid link (50) is mounted in the link recess (33). The other mounting ends of the rigid link (50) is alternately mounted in the stationary recess (22) and the sole recess (42).

The fastening holes (51) are respectively formed through the two mounting ends of the rigid link (50) and correspond respectively to the connecting hole (330) and a corresponding fixing hole (220, 420). The fasteners (3) are respectively mounted through the fastening holes (51) and respectively in the connecting hole (330) and the corresponding fixing hole (220, 420) of the stationary heel (20) and moving sole (40) and may be bolts, set screws or the like.

Figure 4:
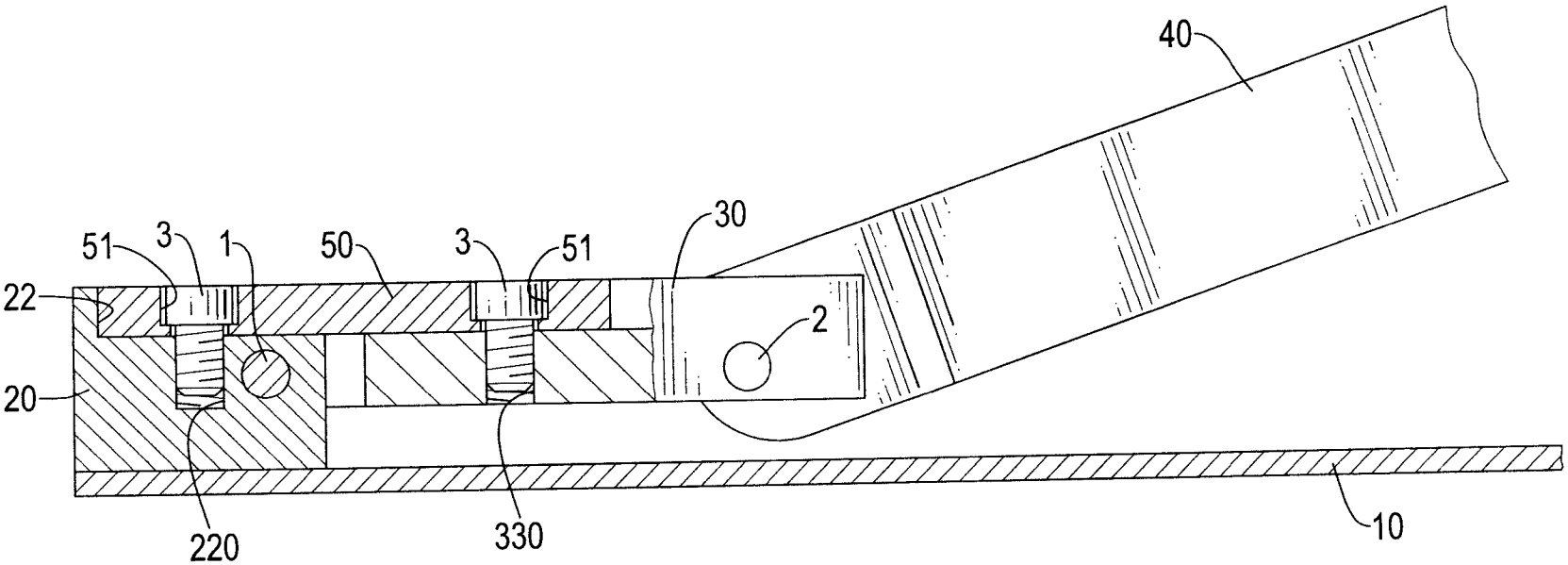
FIG. 4 is a side view in partial section of the adjustable pedal assembly in FIG. 2.

With further reference to FIG. 4, when the two mounting ends of the rigid link (50) are respectively mounted in the link recess (33) and stationary recess (22) to connect the stationary heel (20) and the adjustment bracket (30) together, the pivoting point of the pedal is at the sole shaft (2) and the swinging length of the pedal equivalent to a length of the moving sole (40). Consequently, the pedal assembly can be applied for heavy stamping.

Figure 5:
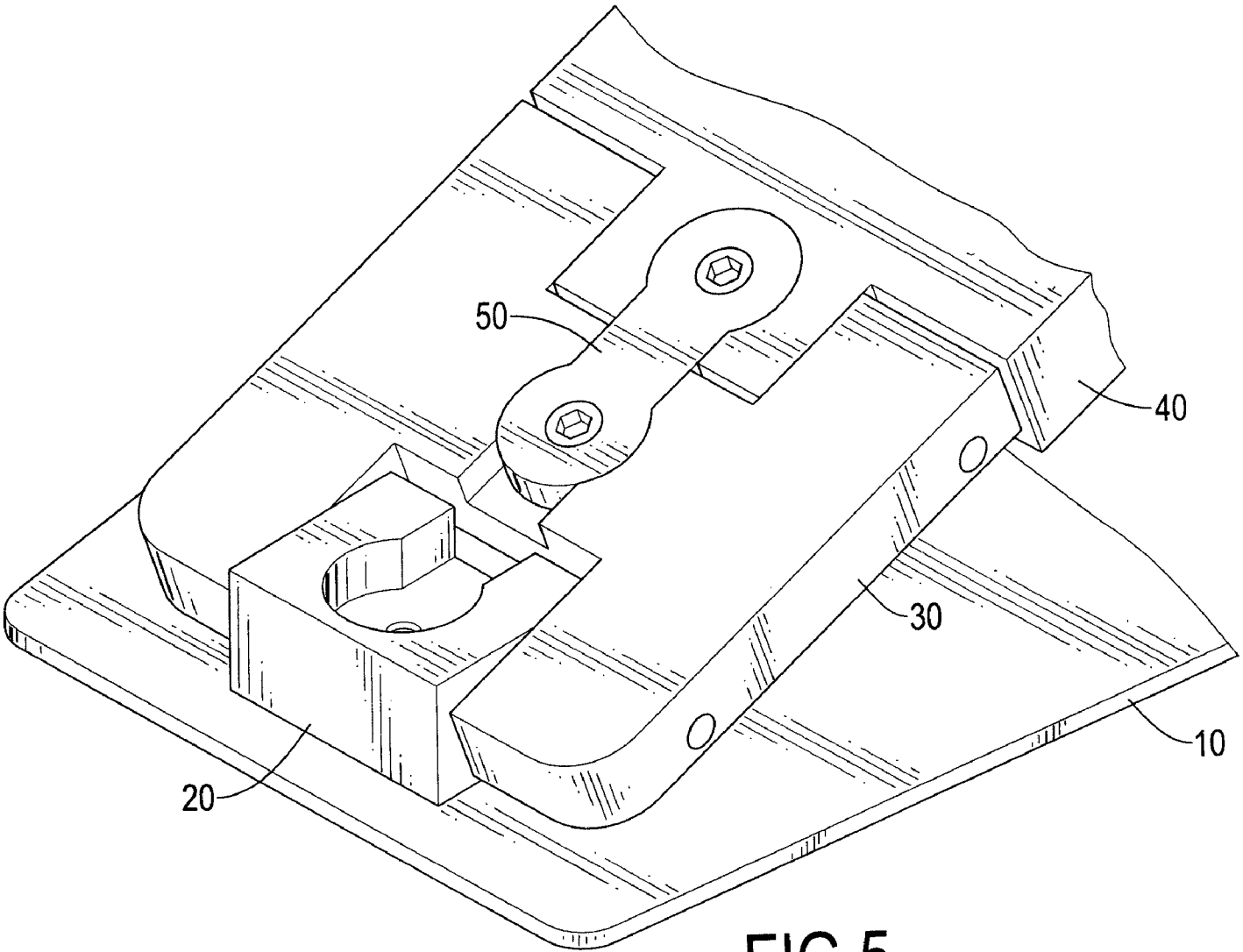
FIG. 5 is an enlarged, operational perspective view of the adjustable pedal assembly in FIG. 1 with the pedal being adjusted in different length.
Figure 6:
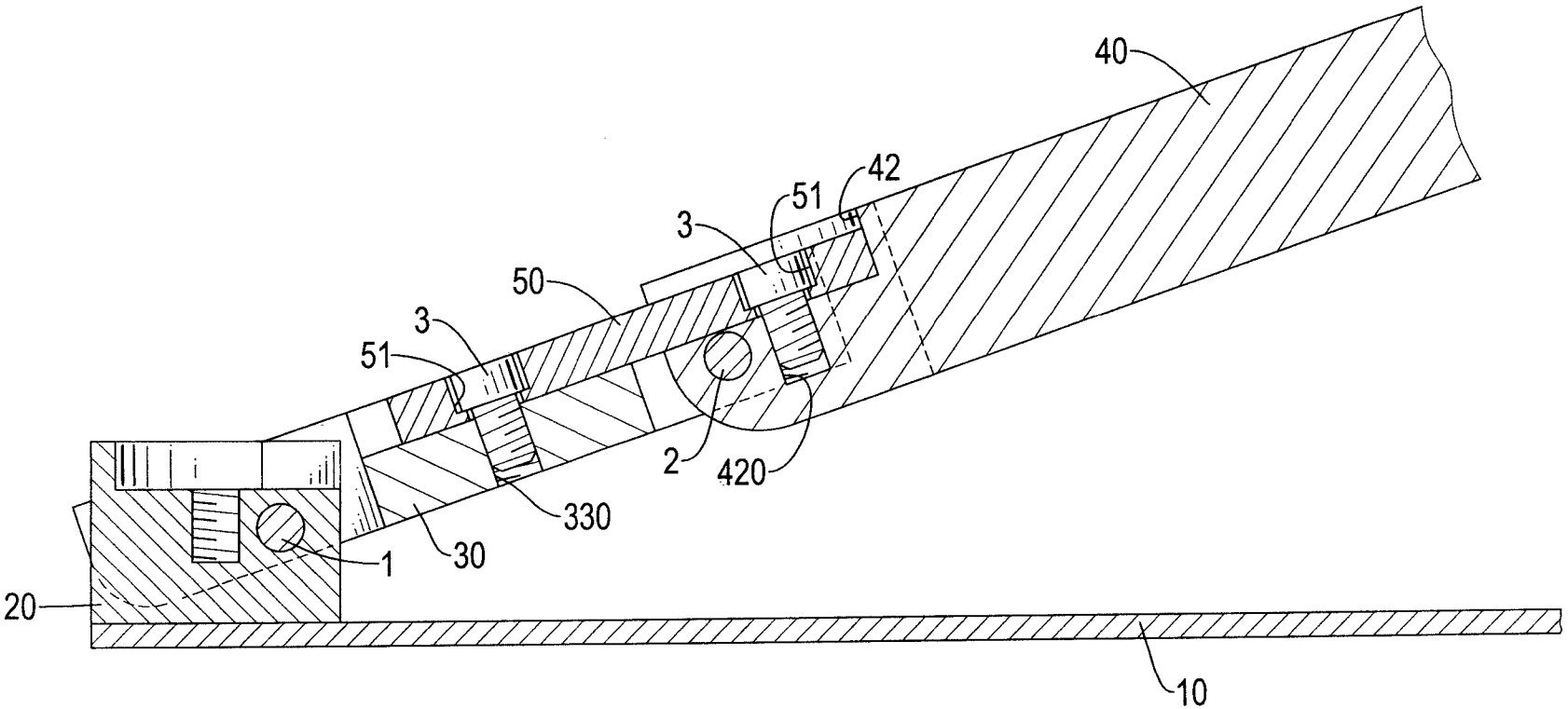
FIG. 6 is a side view in partial section of the adjustable pedal assembly in FIG. 5.
Figure 7:
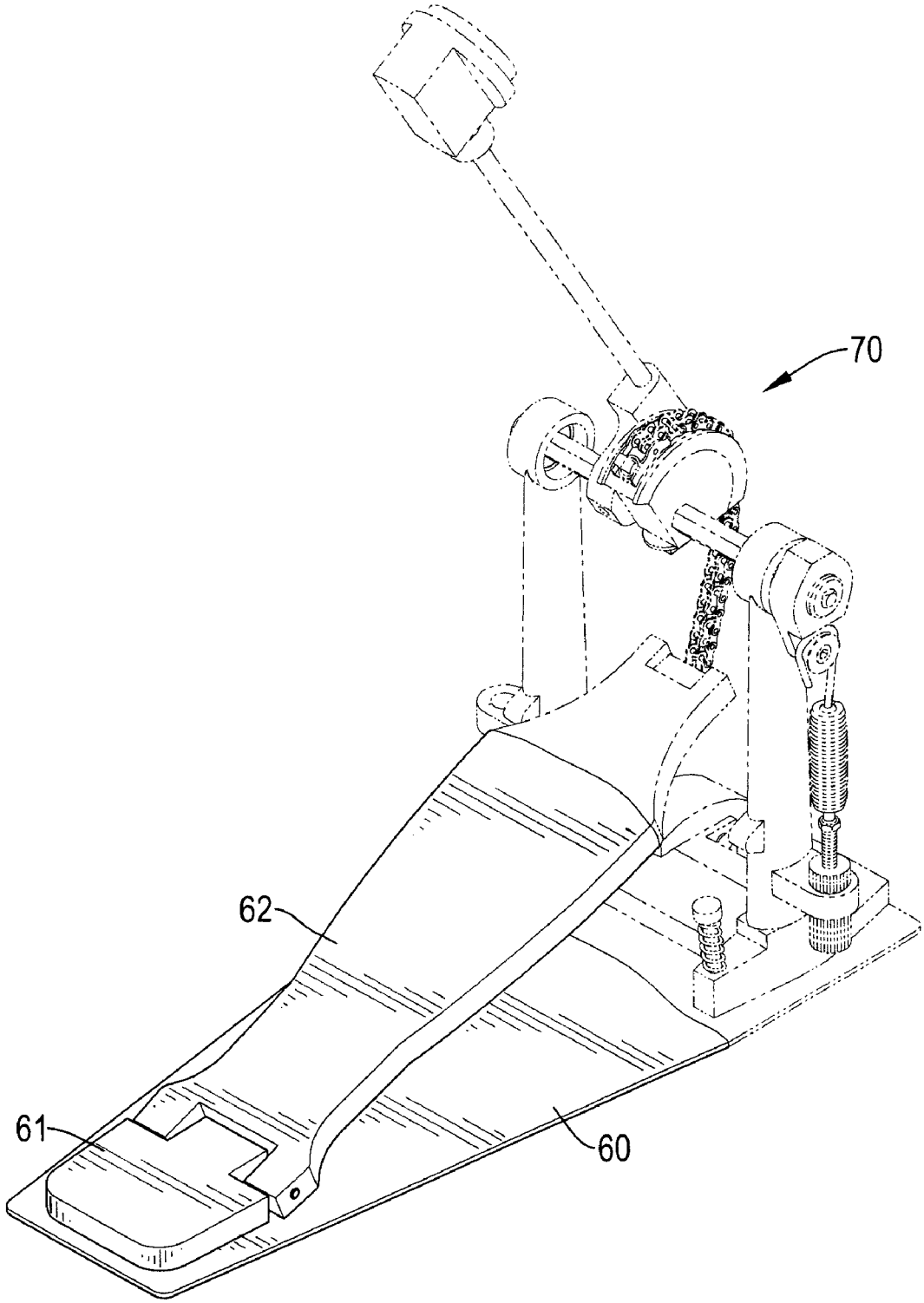
FIG.7 PRIOR ART
FIG. 7 is a perspective view of a conventional pedal assembly in accordance with the prior art.

With further reference to FIGS. 5 and 6, when the two mounting ends of the rigid link (50) are respectively mounted in the link recess (33) and sole recess (42) to connect the adjustment bracket (30) and the moving sole (40) together, the pivoting point of the pedal is adjusted to the stationary shaft (1) and the swinging length of the pedal is equivalent to the length of the moving sole (40) and a length of the adjustment bracket (30). When the swinging length of the pedal is increased, the stamping force for driving the beater assembly is accordingly decreased. Therefore, the adjustable pedal assembly can be applied for light stamping.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An adjustable pedal assembly comprising:

a base having a pedal end; and a beater end;

a beater assembly being mounted on the beater end of the base; and a pedal being mounted pivotally on the base and connected to the beater assembly and having a stationary heel being mounted on the pedal end of the base;

an adjustment bracket being pivotally connected to the stationary heel, and having a stationary pivoting end being connected pivotally to the stationary heel;

a central segment being formed on and protruding from the stationary pivoting end; and a sole pivoting end being connected to the central segment;

a moving sole being connected pivotally to the adjustment bracket, connected to the beater assembly and having a pivoting end being connected pivotally to the sole pivoting end of the adjustment bracket; and a beater end being connected to the beater assembly; and a rigid link having two ends, one of the ends of the rigid link being connected to the adjustment bracket and the other end of the rigid link being alternately connected to the stationary heel and the moving sole.

2. The adjustable pedal assembly as claimed in claim 1, wherein the stationary heel further has a stationary recess being formed in the stationary heel and having a bottom; and a fixing hole being formed in the bottom of the stationary recess;

the central segment of the adjustment bracket further has a link recess being formed in the central segment and aligned with the stationary recess and having a bottom; and a connecting hole being formed in the bottom of the link recess;

the pivoting end of the moving sole further has a sole recess being formed in the pivoting end of the moving sole and aligned with the link recess of the adjustment bracket and having a bottom;

a fixing hole being formed in the bottom of the sole recess;

the rigid link further has two mounting ends, one of the ends being mounted in the link recess, the other end being alternately mounted in the stationary recess and the sole recess;

two fastening holes being respectively formed through the two mounting ends; and two fasteners being respectively mounted through the fastening holes, one of the fasteners being mounted in the connecting hole, the other fastener being alternately mounted in the fixing holes of the stationary heel and moving sole.

3. The adjustable music pedal as claimed in claim 1, wherein the stationary heel further has a stationary pivoting hole being transversally formed through the stationary heel; and the adjustment bracket further has a stationary through hole being formed through the stationary pivoting end of the adjustment bracket and aligning with the stationary pivoting hole; and a stationary shaft being mounted through the stationary through hole and stationary pivoting hole.

4. The adjustable music pedal as claimed in claim 2, wherein the stationary heel further has a stationary pivoting hole being transversally formed through the stationary heel; and the adjustment bracket further has a stationary through hole being formed through the stationary pivoting end of the adjustment bracket and aligning with the stationary pivoting hole; and a stationary shaft being mounted in the stationary through hole and stationary pivoting hole.

5. The adjustable music pedal as claimed in claim 1, wherein the adjustment bracket further has a sole through hole being transversally formed through the sole pivoting end;

the moving sole further has a sole pivoting hole being formed through the pivoting end of the moving sole, and aligning with the sole through hole; and a sole shaft being mounted through the sole through hole and the sole pivoting hole.

6. The adjustable music pedal as claimed in claim 2, wherein the adjustment bracket further has a sole through hole being transversally formed through the sole pivoting end;

the moving sole further has a sole pivoting hole being formed through the pivoting end of the moving sole, and aligning with the a sole through hole; and a sole shaft being mounted in the sole through hole and the sole pivoting hole.

7. The adjustable music pedal as claimed in claim 3, wherein the adjustment bracket further has a sole through hole being transversally formed through the sole pivoting end;

the moving sole further has a sole pivoting hole being formed through the pivoting end of the moving sole, and aligning with the a sole through hole; and a sole shaft being mounted in the sole through hole and the sole pivoting hole.

8. The adjustable music pedal as claimed in claim 4, wherein the adjustment bracket further has a sole through hole being transversally formed through the sole pivoting end;

the moving sole further has a sole pivoting hole being formed through the pivoting end of the moving sole, and aligning with the a sole through hole; and a sole shaft being mounted in the sole through hole and the sole pivoting hole.

9. The adjustable music pedal as claimed in claim 2, wherein the fasteners are bolts; and the fixing and connecting holes are threaded holes.

10. The adjustable music pedal as claimed in claim 8, wherein the fasteners are bolts; and the fixing and connecting holes are threaded holes.

* * * * *